US006474906B1

(12) United States Patent
Cunningham et al.

(10) Patent No.: US 6,474,906 B1
(45) Date of Patent: Nov. 5, 2002

(54) SINGLE ROLLER CONCRETE FINISHING MACHINE

(75) Inventors: John Cunningham, Hurricane, WV (US); Jay Phillips, Scott Depot, WV (US); Larry Redman, Cross Lanes, WV (US); Virgil Sargent, Windield, WV (US); Carl McCormick, Charleston, WV (US)

(73) Assignee: Terramite Corporation, Charleston, WV (US)

( * ) Notice: Subject to any disclaimer, the term of this patent is extended or adjusted under 35 U.S.C. 154(b) by 0 days.

(21) Appl. No.: 09/457,760

(22) Filed: Dec. 10, 1999

(51) Int. Cl.[7] ..... E01C 19/24
(52) U.S. Cl. ..... 404/103; 404/85; 404/118
(58) Field of Search ..... 404/75, 103, 117, 404/118, 131, 112, 132, 114, 85

(56) References Cited

U.S. PATENT DOCUMENTS

| | | | | | |
|---|---|---|---|---|---|
| 976,293 | A | | 11/1910 | Reiff | |
| 2,134,884 | A | | 11/1938 | Moore, Jr. | |
| 2,306,126 | A | * | 12/1942 | Jackson | 404/114 |
| 2,314,985 | A | * | 3/1943 | Jackson | 404/114 |
| 2,584,459 | A | * | 2/1952 | Jackson | 404/114 |
| 3,052,167 | A | | 9/1962 | Beale | |
| 3,605,577 | A | | 9/1971 | Bik | |
| 3,989,403 | A | * | 11/1976 | Verive | 404/111 |
| 4,142,815 | A | | 3/1979 | Mitchell | |
| 4,192,387 | A | * | 3/1980 | Stinson | 172/21 |
| 4,208,151 | A | * | 6/1980 | Cross | 404/122 |
| 4,367,880 | A | | 1/1983 | Harding | |
| 4,386,901 | A | * | 6/1983 | Morrison | 404/118 |

(List continued on next page.)

FOREIGN PATENT DOCUMENTS

WO WO 98/38384 * 9/1998 ..... E01C/19/29

OTHER PUBLICATIONS

"Solo Screed", by the Terramite Corporation, from www-.terramite.com.*

"Self Propelled Concrete Roller Screeds", by J.D. Concrete Screed.*

"Roller Screed", by the Terramite Corporation.*

*Primary Examiner*—Robert E. Pezzuto
*Assistant Examiner*—Alexandra K. Pechhold
(74) *Attorney, Agent, or Firm*—Sughrue Mion, PLLC

(57) ABSTRACT

A single roller concrete finishing machine for finishing a concrete surface includes a primary motorized unit and a secondary unmotorized unit disposed on each side of a surface to be paved, with a single roller disposed on the unfinished surface which connects the primary unit and the secondary unit. The primary unit includes a first base having an elongated first handle having two ends, one end of the first handle being connected to the first base, and the other end of the first handle being connected to handlebars, below which an engaging lever is disposed. The secondary unit includes a second base with an elongated second handle similar to the first handle, but without the engaging lever. The handles of each of the primary unit and the secondary unit are swingably adjustable in a horizontal plane to aid in the leveling of the concrete surface to be finished. The primary unit has an engine mounted on the first base, and a mechanism to rotate the roller. When the engine is turned on, the roller does not rotate. Only when the engaging lever is pressed, does the roller tube rotate, in order to drive the primary unit forward, bringing the secondary unit with it, so that the forward motion of the concrete finishing machine, coupled with the pulling backward motion of the operator and helper, can level the concrete.

1 Claim, 7 Drawing Sheets

U.S. PATENT DOCUMENTS 4,614,486 A 9/1986 Bragagnini
4,650,366 A * 3/1987 Morrison ..... 404/114
4,702,640 A 10/1987 Allen
4,752,156 A 6/1988 Owens
5,016,319 A 5/1991 Stigen
5,062,738 A 11/1991 Owens
5,088,273 A * 2/1992 Braun et al. ..... 56/10.5
5,190,401 A 3/1993 Wilson
5,234,283 A * 8/1993 Adkins ..... 404/97
5,241,946 A * 9/1993 Yelton et al. ..... 125/14
5,533,830 A * 7/1996 Barichello ..... 404/96
5,605,415 A * 2/1997 Shamblin ..... 404/118
5,672,027 A * 9/1997 Wadensten ..... 404/133.05
5,803,656 A 9/1998 Turck
5,947,493 A * 9/1999 Pasin et al. ..... 280/47.34

* cited by examiner

SINGLE ROLLER CONCRETE FINISHING MACHINE

The present invention relates to a single roller concrete finishing machine, which can finish the surface of concrete roads, pavements, sidewalks, floors, platforms, etc., in a smooth texture.

BACKGROUND OF THE INVENTION

Concrete finishing goes back many decades and various roller devices have been used to effect a screeding, or finishing of the concrete material in a given area. Many of these machines are designed to operate on rails (screeds) or form walls and are utilized to effect a leveling of the unset concrete within the form. Typically, grading and finishing work has been accomplished by hand operated screeds or trowels. However, manual operations have made grading and finishing of concrete surfaces time consuming and expensive.

In attempting to ease the time and cost burdens in grading and finishing concrete surfaces, powered, roller-type screeds are used to finish a surface in order to make it level and smooth.

Description of the Related Art

Conventional powered, roller-type screeds such as the device disclosed in Mitchell, U.S. Pat. No. 4,142,815, includes a counter-rotating elongated roller with a manually movable support frame connected to only one end of the roller to allow push-pull control of the roller by an operator from one side of the form, with a motor mounted on the support frame and connected to drive the roller. Mitchell suffers from the problem exhibited by the prior art, in that it still takes a great deal of manual effort to move the device. Further, control of the support frame, whose movement has a direct effect on the movement of the roller, is difficult, even with another manual pull device coupled to the opposite end of the roller to allow auxiliary pull control of the roller.

Other prior art devices, such as Turck, U.S. Pat. No. 5,803,656, and Owens U.S. Pat. No. 4,752,156, disclose a walk-behind chassis, with the chassis in Turck being attached to a roller. In both cases, the walk-behind chassis makes the working conditions for the operators difficult, as well as control of the screeds harder to operate.

Still other conventional powered roller-type screed apparatuses, such as Allen, U.S. Pat. No. 4,702, 640, and Owens U.S. Pat. No. 5,062,738, disclose portable screeds with operator units at each end of the screed. However, in Allen, a winch system is used to facilitate uphill and downhill translation of the concrete finisher on a sloping concrete surface, and enables the system to be operated by one person. The addition of the winch system makes the powered roller-type screed apparatus more complicated.

As for Owens, the device in Owens uses an elongated screed plate which has a pair of control bars mounted so that operators may guide the screed over a concrete surface contained between a pair of forms. However, the screed plate is connected to a stiffening brace (i.e., chassis), and the brace includes a longitudinal concave scoop extending the length of its facing side for collecting excess concrete as the screed is drawn along the concrete. This concave scoop complicates the machinery and makes it more difficult to handle.

Thus, all the prior art single roller concrete finishing machines suffer from the same deficiencies, in that they complicate the machinery and make the finishing of the concrete surface difficult for the operators.

SUMMARY OF THE INVENTION

An object of the present invention is to provide a powered single roller concrete finishing machine, which can finish a concrete surface, but which has a simple mechanical construction.

In fulfilling the above objectives, the present invention includes a concrete finishing machine having a primary motorized unit and a secondary unmotorized unit disposed on each side of a surface to be paved, with a single roller disposed on the unfinished surface which connects the primary unit and the secondary unit. The primary unit includes a first base having an elongated first handle having two ends, one end of the first handle being connected to the first base, and the other end of the first handle being connected to handlebars, below which an engaging lever is disposed. The secondary unit includes a second base with an elongated second handle similar to the first handle, but without the engaging lever. The handles of each of the primary unit and the secondary unit are swingably adjustable in a horizontal plane to aid in the leveling of the concrete surface to be finished. The primary unit has an engine mounted on the first base, and a mechanism to rotate the roller. When the engine is turned on, the roller does not rotate. Only when the engaging lever is pressed, does the roller tube rotate, so that the forward motion of the concrete finishing machine, coupled with the pulling backward motion of the operator and helper, can level the concrete. The roller is stopped from rotating when the engaging lever is released.

When the primary and secondary units are not in use, they rest on an adjustable foot which protrudes downwardly from a rear side of the handle. When the primary unit and the secondary unit are not connected to the roller, they can be moved by lifting the handle onto a pair of wheels disposed at a front of each of the units.

These and other objects and advantages of the present invention will become apparent in the course of the following description.

BRIEF DESCRIPTION OF THE DRAWINGS

Other features and advantages of the invention will be apparent from the following description taken in connection with the accompanying drawings, wherein.

DETAILED DESCRIPTION OF THE PREFERRED EMBODIMENTS

Figure 1:
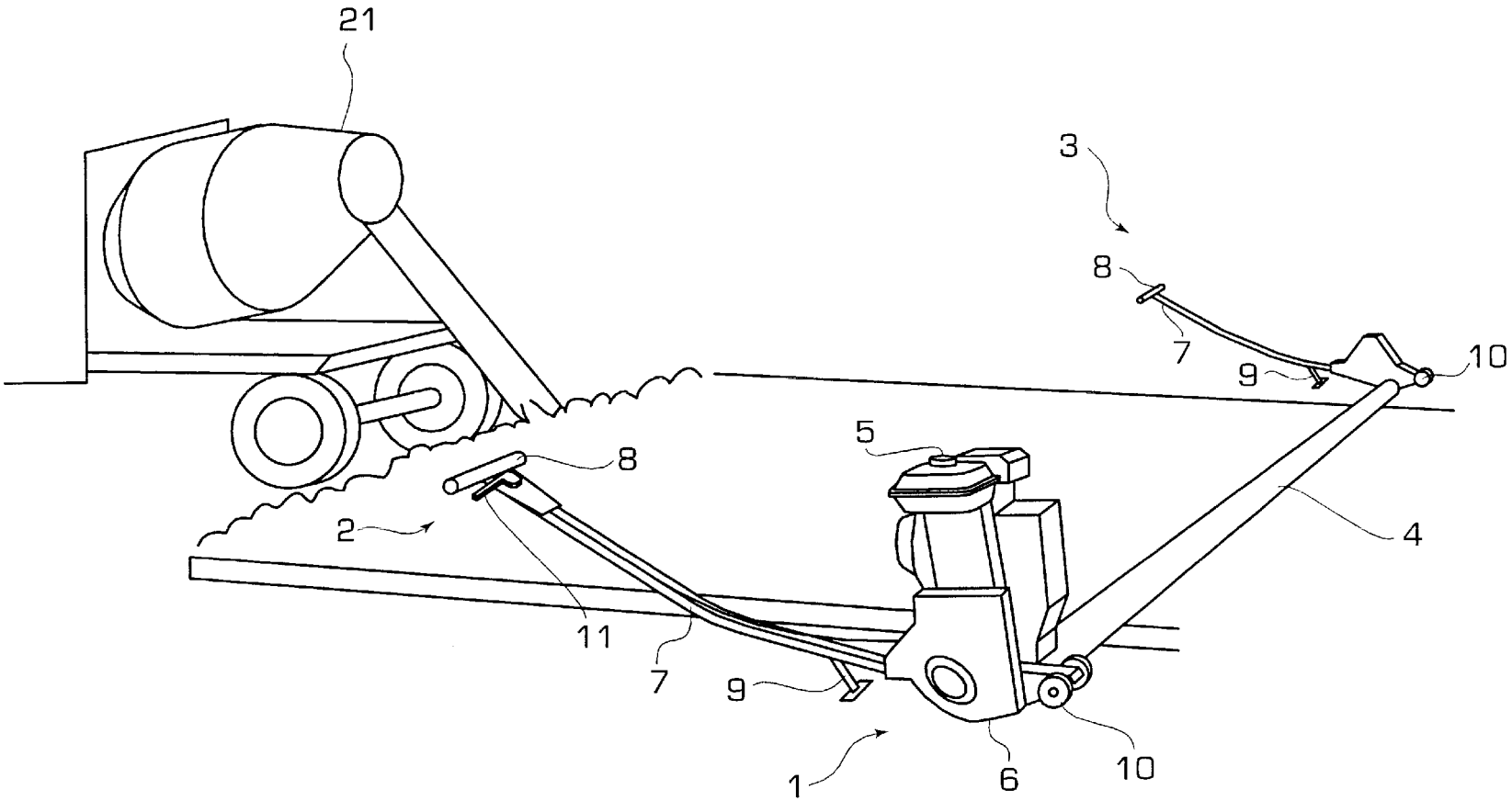
FIG. 1 shows a perspective view of the single roller concrete finishing machine.

The present invention relates to a single roller concrete finishing machine, which can finish a concrete surface such as a sidewalk, road surface, or similar pavement structure. The single roller concrete finishing machine 1 (see FIG. 1) includes a primary unit 2 and a secondary unit 3 connected by a single roller tube 4, the primary 2 and the secondary 3 units both being hand-operated by a user and a helper, respectively.

The primary unit 2 of the single roller concrete finishing machine 1 includes an engine 5 mounted on a base 6, the base 6 having an elongated handle 7 attached to a rear portion of the base 6. The handle 7 extends diagonally upwardly from the base 6 to culminate in handlebars 8 projecting perpendicularly from the handle 7.

The handle 7 has an adjustable foot 9 which projects diagonally toward the ground from an underside of the handle 7, so that when the single roller machine 1 is at rest, the adjustable foot 9, which is positioned at the center of gravity of the single roller machine 1, handles the weight of the primary unit 2 to prevent the handle 7 from upending the base 6 having the engine 5 mounted on top.

For ease of movement when the primary unit 2 is not in operation, a pair of wheels 10 at the front of the primary unit 2 can be utilized by lifting the handle 7 upwardly so that the adjustable foot 9 no longer touches the ground. The primary unit 2 can then be physically propelled forward on the wheels 10, by the operator.

Figure 2:
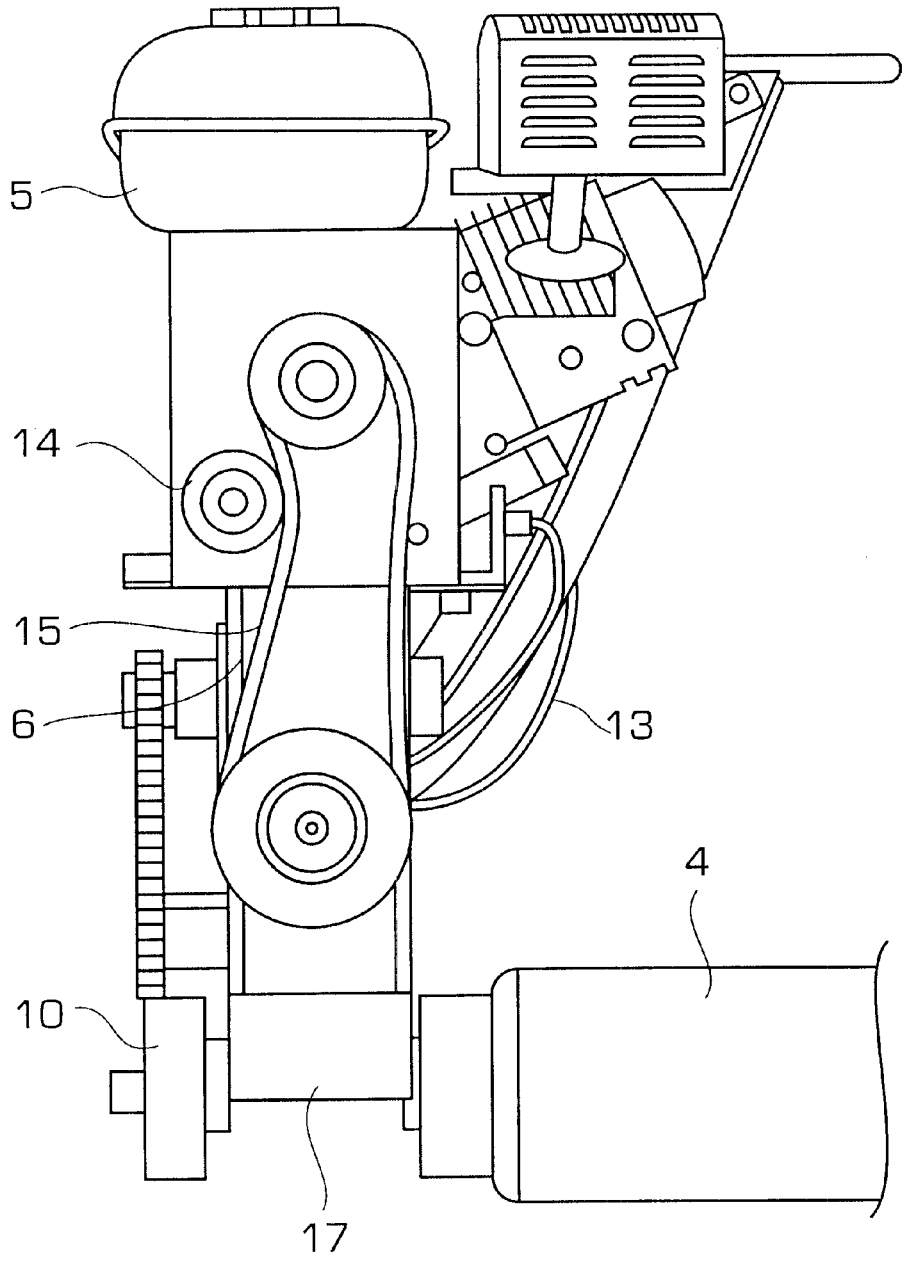
FIG. 2 shows a front view of the primary unit of the single roller concrete finishing machine with the drive bearing not pulled into the belt.
Figure 3:
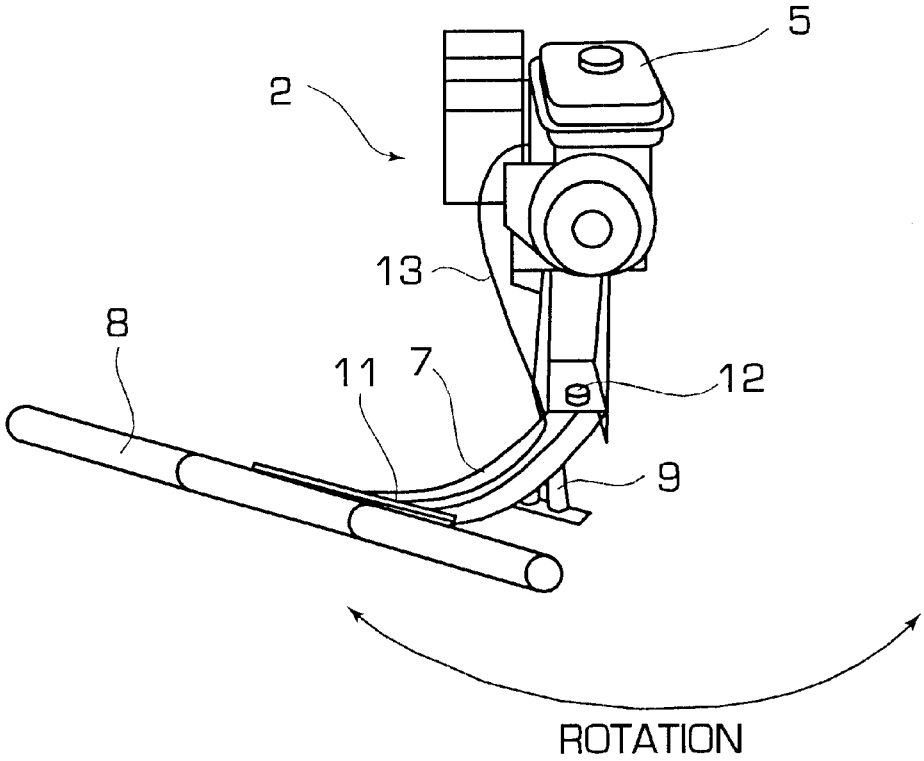
FIG. 3 shows a top view of the primary unit of the single roller concrete finishing machine.

The primary unit 2 has a drive motor or engine 5 (see FIG. 2), preferably, but not necessarily a conventional I.C. engine, either vertically or horizontally mounted, which is turned on and off by hand by the operator. Once the engine 5 is turned on in the usual manner by pulling on a rope or other suitable starting mechanism (not shown), the primary unit 2 can be engaged to move forward. By placing the engine 5 directly on the primary unit 2, greater control can be achieved than if the engine 5 is directly attached to roller tube 4.

Figure 6:
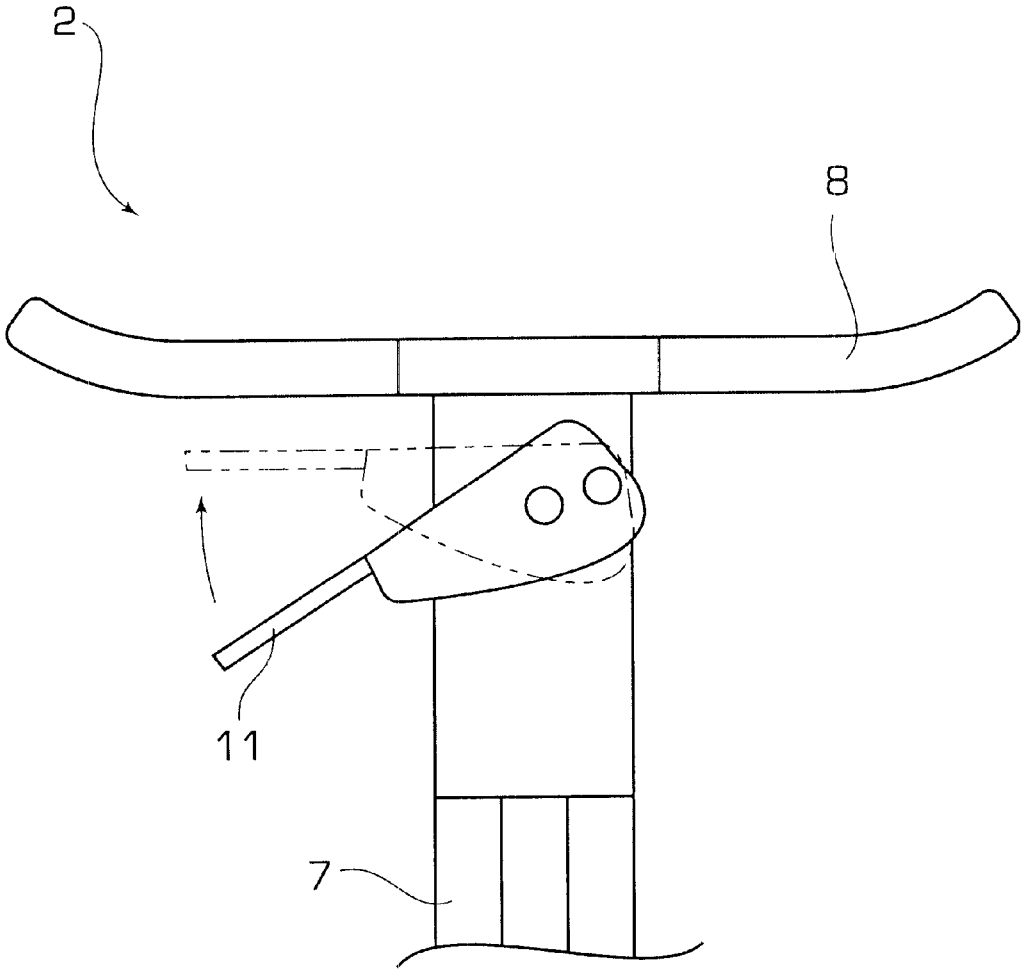
FIG. 6 shows a front view of the engaging lever of the primary unit of the single roller concrete finishing machine in the engaged position, and in the disengaged position.

The handle 7 of the primary unit 2 has an engaging lever 11 (see FIGS. 1 and 6) disposed directly below the handlebars 8, within easy reach of the operator. When the operator wishes the primary unit 2 to move forward, he or she grips the engaging lever 11 and pulls it from a DISENGAGED position diagonal to the handlebars 8 (see FIG. 6—solid lines), to a horizontal position, which is the ENGAGED position (see FIG. 6—dashed lines), in line with the handlebars 8. When the operator releases his or her grip on the engaging lever 11, the lever 11 returns to its DISENGAGED position.

The handle 7 is swingably adjustable in a horizontal plane, by rotating around a pin 12 at the base of the handle 7 which is attached to the base 6. The swingable motion of the handle 7 is useful for handling the movement of the primary unit 2, and thus, the single roller machine 1, and for paving around obstructions.

Figure 4A:
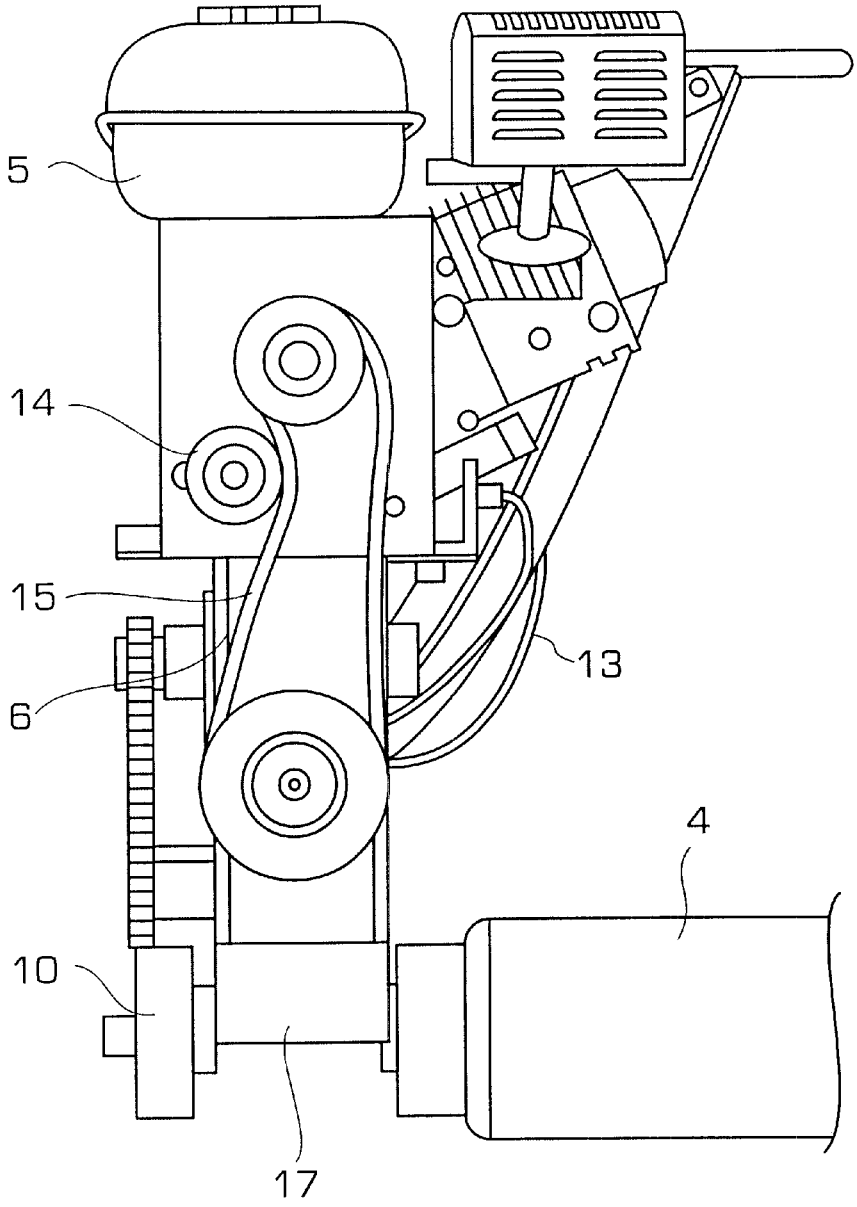
FIG. 4A shows a front view of the primary unit of the single roller concrete finishing machine with the drive bearing pulled into the belt.
Figure 4B:
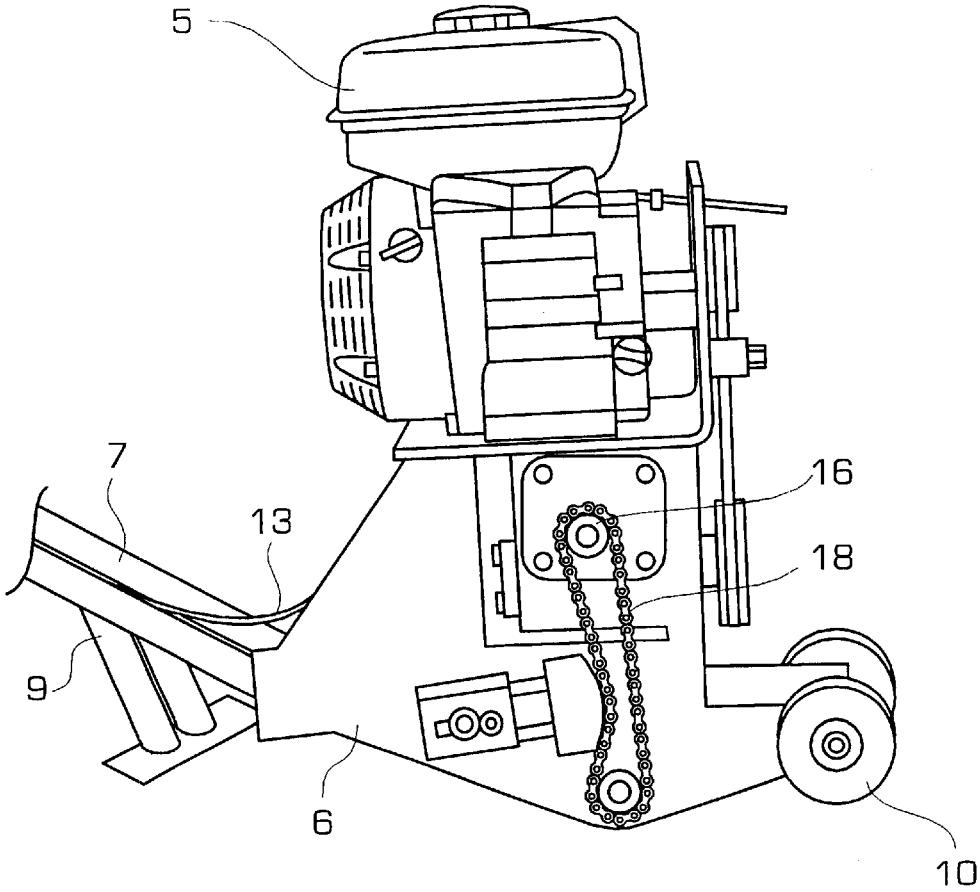
FIG. 4B shows a side view of the primary unit of the single roller concrete finishing machine with the drive bearing pulled into the belt.

In the primary unit 2, a cable 13 (see FIG. 2) connects the engaging lever 11 to a drive bearing 14 on the base 6. When the cable 13 is pulled due to the engaging lever 11 being moved into the ENGAGED position, the cable 13 forces the drive bearing into the belt 15, tightening the belt 15 (see FIG. 4A). As the belt 15 tightens, it transmits power to the speed reducer 16 (see FIG. 4B), which in turn transmits power to the drive shaft 17 (see FIGS. 4A and 4B) via the sprocket chain 18. As the drive shaft 17 rotates, the roller tube 4, which is attached to the drive shaft 17 of the primary unit 2, rotates clockwise in FIG. 1 (away from the operator), and the primary unit 2 tends to move forward (away from the operator).

If the engaging lever 11 is released and moves to the DISENGAGED position (see FIG. 6), the drive bearing 14 moves away from the belt 15 (see FIG. 2), the belt 15 loses tension, and the primary unit 2 comes to a complete stop. The engine 5 then can be turned off in the usual manner by pushing a stop button or other mechanism (not shown).

Figure 5:
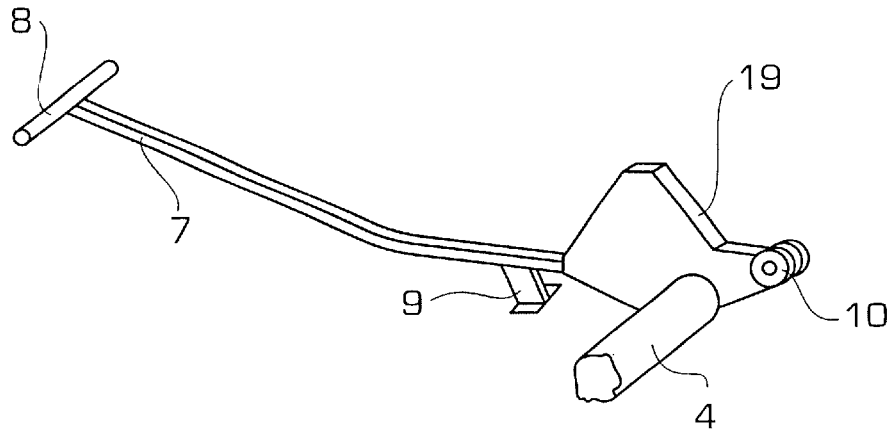
FIG. 5 shows a side view of the secondary unit of the single roller concrete finishing machine.

The secondary unit 3 (see FIGS. 1 and 5) includes a base 19, a handle 7 with handlebars 8, the handle 7 being swingably adjustable like the handle 7 of the primary unit 2, an adjustable foot 9, and wheels 10, similar to the primary unit 2. However, the major difference between the secondary unit 3 and the primary unit 2 is that the secondary unit 3 does not have an engine 5 mounted on the base 6. The roller tube 4 which is connected to the drive shaft 17 of the primary unit 2, is connected to a turning shaft 20 of the secondary unit 3.

In operation, a roller tube 4 is connected to the drive shaft 17 of the primary unit 2 of the single roller machine 1, and to a turning shaft of the secondary unit 3 of the single roller machine 1, with both the units 2, 3 facing in the same direction.

Once both the operator of the primary unit 2 and the helper of the secondary unit 3 are in position, the operator starts the engine 5 on the primary unit 2, engages the engaging lever 11, and keeps the engaging lever 11 ENGAGED to move the primary unit 2 forward. The rotation of the roller tube 4 moves the single roller tube 4 forward, rotating in the clockwise direction, and the operator and the helper can grip the handlebars 8 tightly to hold back or control the rate of the forward motion.

To travel forward, the operator and the helper simply walk with the primary 2 and secondary 3 units, respectively, as the engaging lever 11 is pressed in the primary unit 2, and the single roller machine 1 will be propelled forward to finish or grade the concrete surface. Due to the height of the concrete finishing surface, the primary unit 2 and secondary unit 3 may not touch the ground and the weight of the two units 2, 3 may rest on the roller tube 4 itself.

To move backwards, to finish the concrete, the operator and helper must pull back on their respective units 2, 3, against the rotation of the roller tube 4. With the rotation of the single roller tube 4 and tube speed, and the pulling effort on behalf of the operator and helper, the concrete can be smoothed to an approximate grade using the single roller machine 1.

The concrete delivery devices 21 (i.e., truck, chutes, etc.) (see FIG. 1) are disposed behind the operator and helper who control the single roller machine 1, and the delivery devices pour the unfinished concrete on the surface to be paved. The single roller machine 1 is moved forward and pulled backward over the unfinished concrete to smooth the unfinished concrete to the approximate grade.

Thus, with the above single roller concrete finishing machine, a simple mechanical construction can be obtained, and the amount of labor necessary to finish the concrete surface can be reduced.

It is contemplated that numerous modifications may be made to the apparatus and procedure of the invention without departing from the spirit and scope of the invention as defined in the following claims.

What is claimed is:

1. A concrete finishing machine comprising:

a roller having a first end and a second end;

a primary motorized unit coupled to said first end of said roller via a drive shaft, said primary motorized unit being individually operable, said primary motorized unit including a first base on which an engine is mounted, said first base having (1) wheels, and (2) a first handle having two ends, one end of said first handle being pivotally connected to said first base via a pin so that said first handle is swingable relative to said first base in a horizontal plane about said pin, said other end of said first handle including a first pair of handlebars;

an engaging lever rotatably mounted on said first handle and coupled to a cable that is connected to a motor mounted on said first base, said engaging lever movable to a first position in which said cable causes said motor to rotate said drive shaft and a second position in which said cable disengages an operative connection between said motor and said drive shaft;

a secondary unmotorized unit coupled to said second end of said roller, said secondary unmotorized unit being individually operable, said secondary unmotorized unit including a second base having (1) wheels, and (2) a second handle having two ends, one end of said second handle being pivotally connected to said second base, said other end of said second handle including a second pair of handlebars, said second handle being swingably adjustable in the horizontal plane; and an adjustable foot respectively projecting from each of said first and said second handles;

wherein each of said primary motorized unit and said secondary unmotorized unit is positionable between (1) a transport position in which said wheels are engaged with the ground, and (2) a finishing position in which entire circumferences of said wheels are elevated above a lower most portion of said roller, such that said wheels do not support said primary motorized unit and said secondary unmotorized unit during a finishing operation; and wherein a relative position between (1) said drive shaft, and (2) said wheels of said primary motorized unit remains constant in said transport and said finishing positions.

* * * * *